United States Patent [19]

Mead et al.

[11] Patent Number: 4,866,632

[45] Date of Patent: Sep. 12, 1989

[54] CONTROL MEANS AND METHOD FOR SOLVENT REFINING UNIT

[75] Inventors: Theodore C. Mead, Port Neches; Betty J. Morris, Houston, both of Tex.

[73] Assignee: Texaco Inc., White Plains, N.Y.

[21] Appl. No.: 121,693

[22] Filed: Nov. 16, 1987

[51] Int. Cl.[4] ..... G06F 15/46; C10G 21/16

[52] U.S. Cl. ..... 364/501; 208/87; 208/327; 364/500; 364/556

[58] Field of Search ..... 364/497, 500, 502, 503, 364/556, 510, 148, 150; 208/33, 87, 317, 326, 327, DIG. 1; 73/53

[56] References Cited

U.S. PATENT DOCUMENTS

| | | | |
|---|---|---|---|
| 3,361,646 | 1/1968 | MacMullan et al. | 364/148 |
| 3,458,432 | 7/1969 | Woodle et al. | 208/327 |
| 3,912,618 | 10/1975 | Dryer | 208/327 |
| 4,053,744 | 10/1977 | Woodle | 364/501 |
| 4,111,218 | 9/1978 | Hobbs | 364/148 |
| 4,162,197 | 7/1979 | Sequeira, Jr. et al. | 364/501 |
| 4,262,791 | 4/1981 | Lynch et al. | 364/501 |
| 4,371,944 | 2/1983 | Stewart et al. | 364/148 |
| 4,390,418 | 6/1983 | Sherman | 208/326 |

*Primary Examiner*—Parshotam S. Lall
*Assistant Examiner*—Kevin J. Teska
*Attorney, Agent, or Firm*—Robert A. Kulason; James J. O'Loughlin; Ronald G. Gillespie

[57] ABSTRACT

The control system and method of the present invention controls a solvent refining unit which treats charge oil with a solvent in a refining tower to yield raffinate and extract-mix, strippers separate the solvent from the raffinate and from the extract-mix to provide refined waxy oil and extract oil, respectively. The solvent is returned to the tower and the refined waxy oil is subsequently dewaxed to provide refined oil. The present invention includes a device which senses the flow rate of the charge oil and provides a corresponding charge oil flow rate signal. The flow rate of the charge oil is controlled in accordance with the charge oil flow rate signal and a control signal. The temperature of the extract oil is sensed and a corresponding temperature signal provided. The temperature signal is used in controlling the temperature of the extract oil in cooperation with a second control signal. A parameter related to the quality of the charge oil and the refined oil and the extract-mix is sensed and corresponding parameter signals provided. A computer provides the first control signal to control the charge oil flow rate and the second control signal to control the temperature in accordance with the sensed charge oil flow rate, the extract oil temperature and the sensed quality parameter signals to achieve an optimum charge oil flow rate-yield operating condition.

17 Claims, 2 Drawing Sheets

CONTROL MEANS AND METHOD FOR SOLVENT REFINING UNIT

BACKGROUND OF THE INVENTION

The present invention maximizes the profitability of a solvent refining unit. Some solvent refining units have tried to maximize the yield for other solvent refining systems such as described in U.S. Pat. No. 3,666,931 and U.S. Pat. No. 3,718,809. These control systems use elaborate schemes to obtain optimum balance of extract oil versus refined oil or relate the quality of the refined oil to the viscosity index using a predicted characteristic constant of the charge oil A and utilizes the economic value of the charge oil, the refined oil and the extract oil to determine the optimum.

FIELD OF THE INVENTION

The present invention relates to refinery units and processes in general and, more particularly, to solvent refining units and processes.

SUMMARY OF THE INVENTION

The control system and method of the present invention controls a solvent refining unit which treats charge oil with a solvent in a refining tower to yield raffinate and extract-mix, strippers seperate the solvent from the raffinate and from the extract-mix to provide refined waxy oil and extract oil, respectively. The solvent is returned to the tower and the refined waxy oil is subsequently dewaxed to provide refined oil. The present invention includes a device which senses the flow rate of the charge oil and provides a corresponding charge oil flow rate signal. The flow rate of the charge oil is controlled in accordance with the charge oil flow rate signal and a control signal. The temperature of the extract oil is sensed and a corresponding temperature signal provided. The temperature signal is used in controlling the temperature of the extract oil in cooperation with a second control signal. A parameter, such as refractive index or gravity, related to the viscosity index of the charge oil and the refined oil and the extract-mix is sensed and corresponding parameter signals provided. A computer provides the first control signal and the second control signal in accordance with the sensed charge oil flow rate, the extract oil temperature and the sensed quality parameter signals to achieve an optimum charge oil flow rate-yield operating condition.

The objects and advantages of the invention will appear more fully hereinafter from a consideration of th detailed description which follows, taken together with the accompanying drawings wherein one embodiment of the invention is illustrated by way of example. It is to be expressly understood, however, that the drawings are for illustration purposes only and not to be construed as defining the limits of the invention.

DESCRIPTION OF THE INVENTION

The present invention has discovered that within the range of operation of the solvent refining unit the refractive index correlates with the viscosity index of the refined oil and that the same is true of the gravity of the various oils. They have also discovered that if one was to maximize yield, it would not necessarily be the optimum condition for the solvent refining unit to operate under, since although the yield might be maximized, that is the actual output of the solvent refining unit may be less than which is desired. Conversely, if the output is maximized, then the yield may not be what is desired. It has been discovered that the optimum condition of operation occurs when the product of the yield and the flow rate of the charge oil to the solvent refining unit has been maximized.

Since the refractive index (or gravity) is an additive property within the ranges employed in solvent refining, it follows that:

$$1.\ r1 = Yr2 + (1-Y)r3$$

in which Y is the yield of the raffinate (as a decimal fraction) and r1, r2, and r3 are the refractive indices of the charge oil, the waxy refined oil and the extract oil, respectively. Solving for the yield Y, equation 1 is rewritten as $$2.\ Y = (r1-r3)/(r2-r3)$$

It is not generally advisable to operate under conditions which afford the highest yield. Such high yields require the most selective conditions; high solvent dosage and low temperature. Since most refining units are solvent-turnover limited, high dosage conditions would require low charge rates to the unit. This results in high utility costs (to recover solvent) and a low rate of product formation. The flow rate of refined oil must approach zero as the flow rate of the charge oil approaches zero. Conversely, very high rates of charge oil must be avoided since under these conditions (assuming solvent turnover constraints), solvent dosage must be low and high temperatures would be required, with consequent low yield. The flow rate of the refined oil would also approach zero as the yield Y approached zero.

What is not obvious, is that when the same charge oil is brought to the same quality level by diverse combinations of solvent dosage and extraction temperature, raffinate viscosities are the same. It is of no use to hold raffinate quality at a given level if viscosity varies since required quality levels (RI's and VI's) differ with different raffinate viscosities. As noted previously, there is an optimum feed rate and yield which will maximize the refined oil flow rate and assure that the unit is operated at maximum efficiency. This optimum is achieved when the mathematical product of the feed rate and the yield is maximized.

Figure 1:
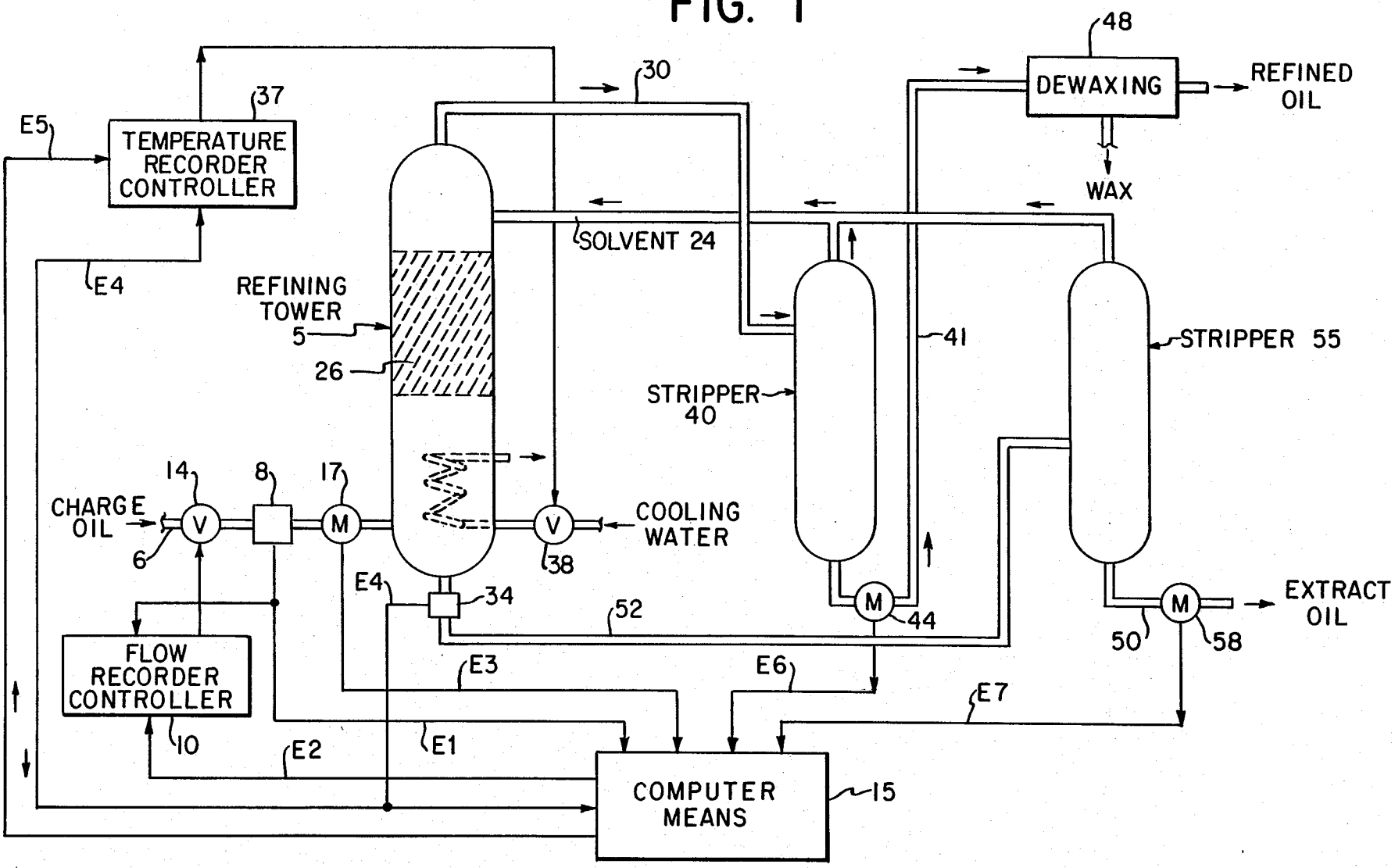
FIG. 1 is a simplified block diagram of a control system for controlling a solvent refining unit.

Referring to FIG. 1, there is shown charge oil entering a solvent refining tower 5 through a line 6. The flow rate of the charge oil is controlled by a flow rate transmitter 8, a flow recorder controller 10 and a valve 14. Transmitter 8 provides a signal E1 to controller 10 and to computer means 15 corresponding to the flow rate of the charge oil. Controller 10 operates valve 14 to control the rate of flow of the charge oil to tower 5 in accordance with signal E1 and a control signal E2 which controls the set points of controller 10. Signal E2 is provided by computer means 15 as hereinafter explained. A meter 17, which may be a refractive index meter or a gravity meter, provides a signal E3 corresponding to a sensed parameter such as the refractive index or the sensed gravity of the charge oil, to computer means 15. Signal E3 also corresponds to r1 in the equations. It should be noted that all meters will be of the same type, i.e. either all refactive index meters or all gravity meters. For ease of explanation, only refractive index meters will be discussed but it will be obvious from this statement that gravity meters may be substituted for the refractive index meters. A refining solvent, which may be furfural or NMP or any other solvent used in solvent refining, enters tower 5 through line 24. Tower 5 contains packing 26 where the charge oil and solvent are contacted in countercurrent flow effecting the extraction of low viscosity index constituents of the charge oil. Alternatively, solvent-oil contact may be brought about by rotating-disk contactors, centrifugal extractors or other devices well known in the art. Raffinate, including the refined waxy oil and a small amount of dissolved solvent is withdrawn through a line 30.

A temperature gradient is maintained in tower 5 by means of a cooling coil 32 having cooling water flowing through it. The temperature in tower 5 is sensed by a conventional type sensing means 34 which provides a corresponding signal E4 to a temperature recorder controller 37 and to computer means 15. Sensing means 34 actually senses the temperature of the extract-mix leaving tower 5. Temperature recorder controller 37 operates a valve 38 in accordance with signal E4 and a control signal E5 from computer means 15. Valve 38 controls the rate of flow of the cooling water to the controller temperature in tower 5.

Raffinate in line 30 enters a stripper 40 which strips the solvent from the raffinate to yield the refined waxy oil. A meter 44 senses parameter (i.e. the refractive index or the gravity) of the refined waxy oil and provides a corresponding signal E6 which also corresponds to r2 in the equations. The solvent, after treatment for the removal of water in any suitable manner, is returned to tower 5 by line 24 while the refined waxy oil in line 41 is provided to dewaxing means 48. Dewaxing means 48 removes the wax and provides refined oil for storage and for blending to provide product lubricating oil.

Extract-mix comprising solvent and dissolved low viscosity index constituents of the charge oil is withdrawn from tower 5 through line 52 at a temperature controlled by cooling coil 32. The extract-mix in line 52 is passed to a stripper 55 where the solvent is stripped from the extract-mix so that stripper 55 discharges extract oil through a line 50. A meter 58 senses the parameter (i.e. the refractive index or the gravity) of the extract oil in line 50 and provides a corresponding signal E7 which also corresponds to r3 in the equations. The recovered solvent is withdrawn through line 24 for return to tower 5 and reuse as was done with the recovered solvent from stripper 40.

Figure 2:
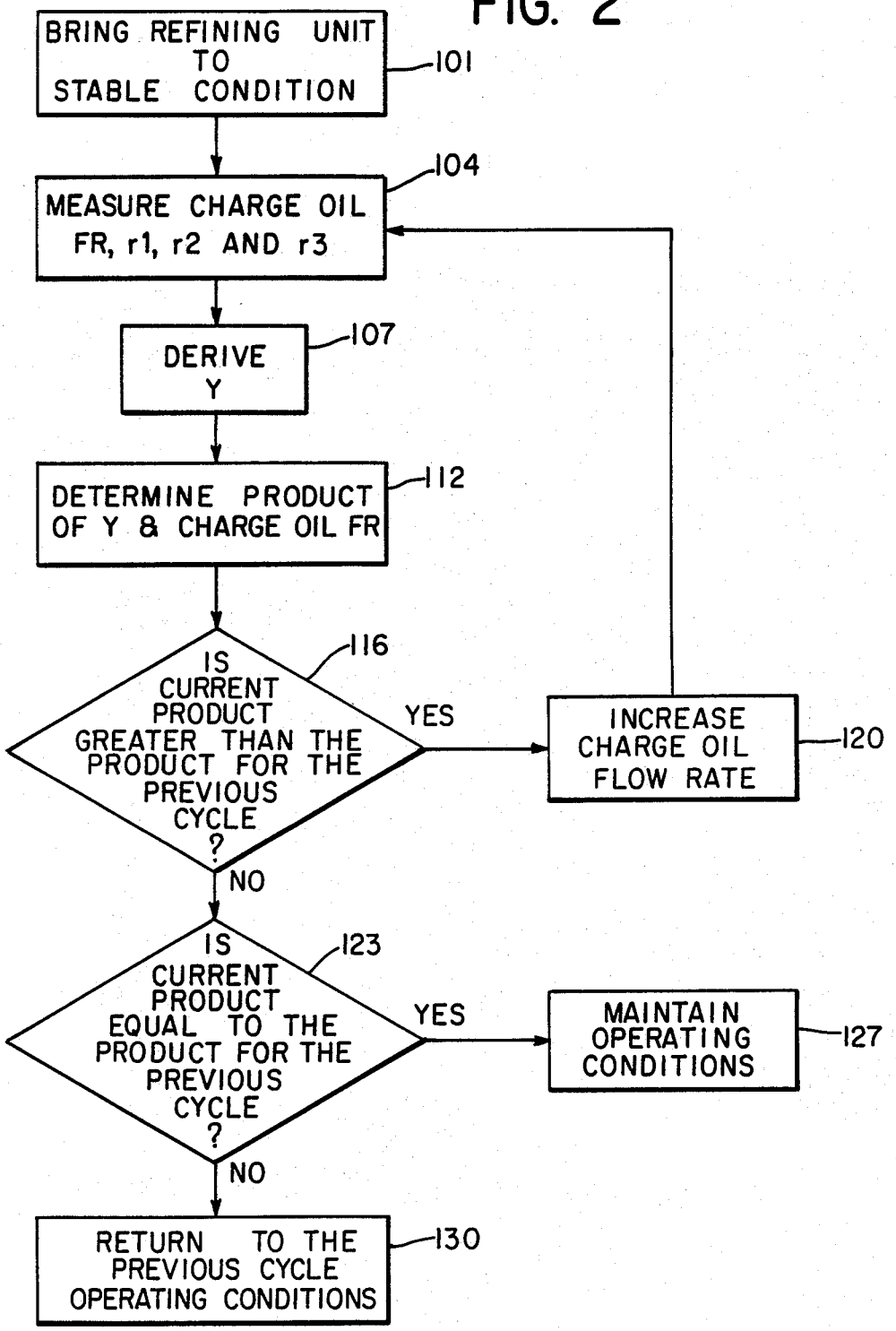
FIG. 2 is a simplified flow diagram of a program for the computer means shown in FIG. 1

With reference to FIG. 2, an operator following the instruction of block 101 brings the refining unit to a stabilized condition. Computer means 15 then measures the charge oil flow rate, r1, r2 and r3, in accordance with signals E3, E6 and E7, respectively, as provided for in block 104. Computer means 15 then derives the yield Y as indicated in block 107. Computer means 15 then determines the product of Y and the charge oil flow rate as indicated in block 112. Computer means 115 then determines if the current product is greater than the product for the next previous cycle. Since this is an initial condition, the current product will be greater than the product for the next previous cycle and therefore the answer is yes. Proceeding to block 120, computer means 15 provides signal E2 to flow recorder controller means causing it to increase the charge oil flow rate to refining tower 5. From block 120 we proceed through blocks 104, 107 and 112 until we arrive at block 116 again. Since there is a value for the previous cycle the answer to the query of block 116 may be no, at which time the computer raises the question is the current product equal to the product for the previous cycle, which is shown in block 123. If the answer to that query is yes, then computer means 115 is directed to maintain operating conditions as provided for in block 127.

If the answer to the query of block 123 is no, computer means 15 is directed to return to the previous cycle operating conditions as provided for in block 130.

What is claimed is:

1. A control system for a solvent refining unit which treats charge oil with a solvent in a refining tower to yield raffinate and extract-mix, strippers separate the solvent from the raffinate and from the extract-mix to provide refined waxy oil and extract oil, respectively, the solvent is returned to the tower and the refined waxy oil is subsequently dewaxed to provide refined oil, comprising:

flow rate sensing means for sensing a flow rate of the charge oil and providing a charge oil flow rate signal corresponding thereto, charge oil control means for controlling the flow rate of the charge oil in accordance with the charge oil flow rate signal and a first control signal, first refractive index sensing means for sensing a refractive index of the charge oil and providing a refractive index signal related thereto, temperature sensing means for sensing a temperature of the extract mix and providing a temperature signal representative of the sensed temperature, temperature control means for controlling the temperature of the extract mix in accordance with the sensed temperature signal and a second control signal, second and third refractive index sensing means for sensing the refractive indexes of the refined waxy oil and the extract oil, respectively, and providing refractive index signals corresponding thereto, control signal means connected to all other means and responsive to the charge oil flow rate signal, to the extract mix temperature signal and to all the refractive index signals for providing the first control signal to the charge oil control means and the second control signal to the temperature control means so as to control the charge oil flow rate and the extract mix temperature to achieve an optimum charge oil flow rate-yield operating condition for the refining unit.

2. A system as described in claim 1 in which the control means includes:

determining means connected to all the refractive index sensing means for utilizing all the refractive index signals to determine the yield of the refining unit.

3. A system as described in claim 2 in which the control means includes:

means connected to the flow rate sensing means, to the charge oil control means and to the determining means for increasing the flow rate of the charge oil until the multiplication product of the charge oil flow rate and the yield is not greater than a next previous multiplication product of charge oil flow rate and yield.

4. A system as described in claim 3 in which the control means further includes:

means for deriving the difference between the refractive index of the charge oil and the refractive index of the extract oil, means for deriving the difference between the refractive index of the refined waxy oil and the refractive index of the extract oil, and means for determining the ratio of the difference between the charge oil and the extract oil refractive indices to the difference between the refined waxy oil and the extract oil refractive indices.

5. A control method for a solvent refining unit which treats charge oil with a solvent in a refining tower to yield raffinate and extract-mix, strippers seperate the solvent from the raffinate and from the extract-mix to provide refined waxy oil and extract oil, respectively, the solvent is returned to the tower and the refined waxy oil is subsequently dewaxed to provide refined oil, comprising the steps:

sensing the flow rate of the charge oil, providing a charge oil flow rate signal corresponding to the sensed flow rate, controlling the flow rate of the charge oil in accordance with the charge oil flow rate signal and a first control signal, sensing a refractive index of the charge oil, providing a first refractive index signal related to the sensed refractive index of the charge oil, sensing the temperature of the extract mix, providing a temperature signal representative of the sensed temperature, controlling the temperature of the extract mix in accordance with the sensed temperature signal and a second control signal, sensing refractive indexes of the refined waxy oil and, providing second and third refractive index signals corresponding to sensed refractive indexes of the refined waxy oil and the extract oil, respectively, and utilizing the charge oil flow rate signal, extract oil temperature signal and all the refractive index signals to provide the first control signal and the second control signal so as to control the, charge oil flow rate and the extract oil temperature to achieve an optimum charge oil flow rate-yield operating condition for the refining unit.

6. A method as described in claim 5 in which the control step includes:

utilizing all the refractive index signals to determine the yield of the refining unit.

7. A method as described in claim 6 in which the control step includes:

increasing the flow rate of the charge oil until the multiplication product of the charge oil flow rate and the yield is not greater than a next previous multiplication product of charge oil flow rate and yield.

8. A method as described in claim 6 in which the control step further includes:

deriving the difference between the refractive index of the charge oil and the refractive index of the extract oil, deriving the difference between the refractive index of the raffinate and the refractive index of the extract oil, and determining the ratio of the difference between the charge oil and the extract oil refractive indices to the difference between the raffinate and the extract oil refractive indices.

9. A control system for a solvent refining unit which treats charge oil with a solvent in a refining tower to yield raffinate and extract-mix, strippers separate the solvent from the raffinate and from the extract-mix to provide refined waxy oil and extract oil, respectively, the solvent is returned to the tower and the refined waxy oil is subsequently dewaxed to provide refined oil, comprising:

flow rate sensing means for sensing the flow rate of the charge oil and providing a charge oil flow rate signal corresponding thereto, charge oil control means for controlling the flow rate of the charge oil in accordance with the charge oil flow rate signal and a first control signal, first gravity sensing means for sensing a gravity of the charge oil and providing a gravity signal related thereto, temperature sensing means for sensing the temperature of the extract mix and providing a temperature signal representative of the sensed temperature, temperature control means for controlling the temperature of the extract mix in accordance with the sensed temperature signal and a second control signal, second and third gravity sensing means for sensing the gravity of the refined waxy oil and the extract oil, respectively, and providing gravity signals corresponding thereto, and control signal means connected to all other means and responsive to the charge oil flow rate signal, the extract mix temperature signal and all the gravity signals for providing the first control signal to the charge oil control means and the second control signal to the temperature control means so as to control the charge oil flow rate and the extract oil temperature to achieve an optimum charge oil flow rate-yield operating condition for the refining unit.

10. A system as described in claim 9 in which the control means includes:

determining means connected to all the gravity sensing means for utilizing all the gravity signals to determine the yield of the refining unit.

11. A system as described in claim 10 in which the control means includes:

means connected to the flow rate sensing means, to the charge oil control means and to the determining means for increasing the flow rate of the charge oil until a multiplication product of the charge oil flow rate and the yield is not greater than a next previous multiplication product of charge oil flow rate and yield.

12. A system as described in claim 11 in which the control means further includes:

means for deriving the difference between the gravity of the charge oil and the gravity of the extract oil, means for deriving the difference between the gravity of the refined waxy oil and the gravity of the extract oil, and means for determining the ratio of the gravity difference between the charge oil and the extract oil to the gravity difference between the refined waxy oil and the extract oil.

13. A system as described in claim 11 in which the control means further includes:

means for deriving the difference between the gravity of the charge oil and the gravity of the extract oil, means for deriving the difference between the gravity of the refined waxy oil and the gravity of the extract oil, and means for determining the ratio of the gravity difference between the charge oil and the extract oil to the gravity difference between the refined waxy oil and the extract oil.

14. A control method for a solvent refining unit which treats charge oil with a solvent in a refining tower to yield raffinate and extract-mix, strippers separate the solvent from the raffinate and from the extract-mix to provide refined waxy oil and extract oil, respectively, the solvent is returned to the tower and the refined waxy oil is subsequently dewaxed to provide refined oil, comprising the steps:

sensing the flow rate of the charge oil, providing a charge oil flow rate signal corresponding to the sensed flow rate, controlling the flow rate of the charge oil in accordance with the charge oil flow rate signal and a first control signal, sensing a gravity of the charge oil, providing a first gravity signal related to the sensed gravity of the charge oil, sensing the temperature of the extract mix, providing a temperature signal representative of the sensed temperature, controlling the temperature of the extract mix in accordance with the sensed temperature signal and a second control signal, sensing the gravities of the refined waxy oil and the extract oil, providing second and third gravity signals corresponding to sensed gravities of the refined waxy oil and the extract oil, respectively, and utilizing the charge oil flow rate signal, the extract oil temperature signal and all the sensed gravity signals to provide the first control signal and the second control signal so as to control the charge oil flow rate and the extract oil temperature to achieve and optimum charge oil flow rate-yield operating condition for the refining unit.

15. A method as described in claim 14 in which the control step includes:

utilizing all the gravity signals to determine the yield of the refining unit.

16. A method as described in claim 15 in which the control step includes:

increasing the flow rate of the charge oil until a multiplication product of the charge oil flow rate and the yield is not greater than a next previous multiplication product of the charge oil flow rate and the yield.

17. A method as described in claim 16 in which the control step further includes:

deriving the difference between the gravity of the charge oil and the gravity of the extract oil, deriving the difference between the gravity of the raffinate and the gravity of the extract oil, and determining the ratio of the gravity difference between the charge oil and the extract oil to the gravity difference between the raffinate and the extract oil.

* * * * *